United States Patent [19]

Witzmann et al.

[11] Patent Number: 4,902,859

[45] Date of Patent: Feb. 20, 1990

[54] CIRCUIT BREAKER MECHANICAL INTERLOCK

[75] Inventors: Gustav Witzmann, Atlanta; John R. Patrick, Stone Mountain, both of Ga.

[73] Assignee: Siemens Energy & Automation, Inc., Alpharetta, Ga.

[21] Appl. No.: 317,892

[22] Filed: Mar. 2, 1989

[51] Int. Cl.[4] ..... H01H 9/26

[52] U.S. Cl. ..... 200/50 C

[58] Field of Search ..... 200/5 B–5 E, 200/50 C; 335/202, 192, 1, 16

[56] References Cited

U.S. PATENT DOCUMENTS 1,535,873 4/1925 Stevens ..... 200/50 C X
3,778,633 12/1973 DeVisser et al. ..... 200/50 C X
4,295,053 10/1981 Kovatch et al. ..... 200/50 C X
4,484,164 11/1984 McClellan et al. ..... 335/16
4,827,089 5/1989 Morris et al. ..... 200/50 C

*Primary Examiner*—J. R. Scott
*Attorney, Agent, or Firm*—Volker R. Ulbrich; James G. Morrow

[57] ABSTRACT

A mechanical interlock for interlocking two circuit breakers such that only one of the circuit breakers is ON at a given time. The interlock is also configured such that it permits both circuit breakers to be OFF at the same time. The interlock includes a pivoting rocker arm and a linkage assembly associated with each breaker, wherein the rocker arm and linkage assemblies cooperate to transfer motion between the tie bars of the circuit breakers.

4 Claims, 5 Drawing Sheets

CIRCUIT BREAKER MECHANICAL INTERLOCK

BACKGROUND OF THE INVENTION

The present invention relates to circuit breakers, and, in particular, to a mechanical interlock for preventing two interlocked circuit breakers from being in the ON position at the same time.

In some applications, provisions are made to supply power to a load from two independent power sources. Accordingly, each power source is coupled to the load with a separate circuit breaker. For example, see the circuit breaker of U.S. Pat. No. 4,484,164 issued on Nov. 20, 1984. Since it is important to prevent the load from being coupled to the two power sources at the same time, it is important to ensure that only one circuit breaker is in the ON position at a given time.

SUMMARY OF THE INVENTION

Accordingly, an object of the present invention is to provide a means for mechanically interlocking two circuit breakers such that while one circuit breaker is in the ON position, the second circuit breaker cannot be turned ON.

The present invention provides an assembly for interlocking a first circuit breaker and a second circuit breaker, wherein the circuit breakers are of the type including a first electrical contact and a tie-bar coupled to a second electrical contact which is engageable with the first electrical contact. The assembly includes: means for restricting movement of the tie bars; a first means for transferring movement between the tie-bar of the first circuit breaker and the means for restricting movement, wherein the first means is coupled to the tie-bar of the first circuit breaker; and a second means for transferring movement between the tie-bar of the second circuit breaker and the means for restricting movement, wherein the second means is coupled to the tie-bar of the second circuit breaker. The first means transfers motion to the means for restricting when the first electrical contact is engaged with the second electrical contact of the first circuit breaker such that the means for restricting transfers movement to the second means such that the second means prevents the first electrical contact from engaging the second electrical contact of the second circuit breaker.

An advantage of the present invention is that it can be retrofitted to many circuit breakers without extensive modification of the circuit breaker. Another advantage of the present invention is that it can be adapted to permit two interlocked circuit breakers to be in the OFF position at the same time.

An embodiment of the invention is explained in further detail below with reference to the accompanying drawings.

DETAILED DESCRIPTION OF THE PREFERRED EMBODIMENT

Structure

Figure 1:
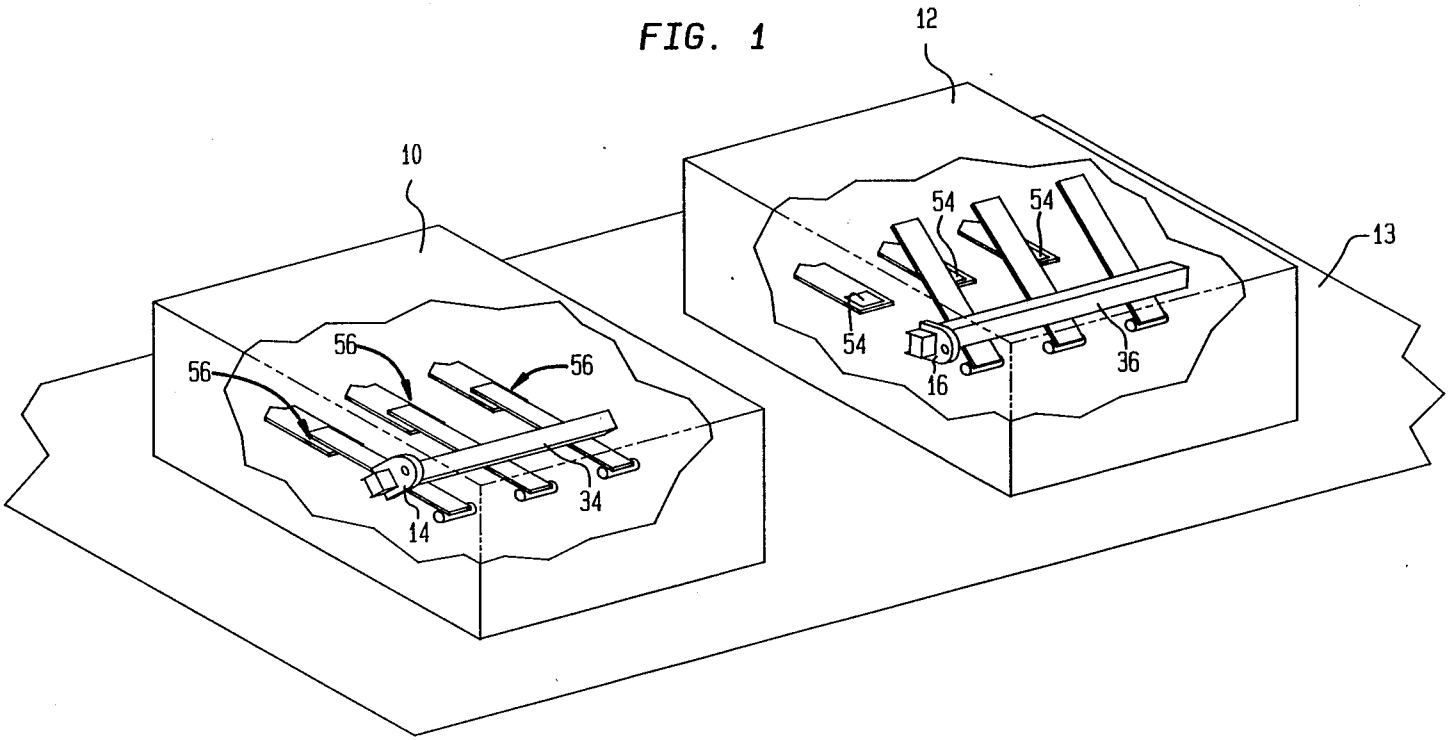
FIG. 1 is a isometric view of two circuit breakers wherein the relationship between the circuit breaker tie-bars and the circuit breakers is schematically represented.

Referring now to the Figures, FIG. 1 schematically illustrates two circuit breakers 10, 12 mounted upon a base plate 13 and coupled to the mechanical interlock. In general, the interlock includes two engagement forks 14, 16, two push-pull rods 18, 20, two links 22, 24, two guide members 26, 28, a rocker arm 30 and a rocker arm pivot bracket 32. These members are individually illustrated in FIGS. 5*a*–5*d*. By way of example only, the forks 14, 16, links 22, 24, guide members 26, 28, arm 30 and bracket 32 can be fabricated from a plated steel.

The forks 14, 16 straddle the circuit breaker tie-bars 34, 36 of the circuit breakers and are pivotally connected to the links 22, 24 with pins 38, 40. These pins 38, 40 ride within the curved slots 42 of the guide members 26, 28 such that forks 14, 16 are guided along a path to ensure that the forks 14, 16 alone do not impede the movement of the tie-bars 34, 36. The guide members 26, 28 are mounted to the base of the circuit breakers with two mounting bolts 43.

The push-pull rods 18, 20 include pivot holes 44 located at the top of the rods 18, 20 and elongated slots 46, 47 located at the bottom of the rods 18, 20. The rods 18, 20 are pivotally attached at their tops to the links 22, 24 with a pin 48 and slidably attached at their bottoms to the rocker arm 30 with a pin 50. To prevent the rods 18, 20 from functioning as an arc path between the circuit breakers 10, 12 and the rocker arm 30, the rods 18, 20 can be fabricated from an electrically insulating material such as a linen base phenolic.

The rocker arm 30 is fabricated to have a U-shaped cross-section which gives the arm 30 an improved beam strength and a means to straddle the rods 18, 20 at the pivot point between the arm 30 and the rods 18, 20. The arm 30 is pivotally supported on the bottom of the base plate 13 with the pivot bracket 32 and a pivot pin 52.

OPERATION

As previously discussed, the interlock functions to prevent two interlocked circuit breakers from being ON at the same time. Additionally, the interlock functions to allow both circuit breakers to be OFF at the same time. In general, these functions are performed by restricting the movement of the circuit breaker tie-bars 34, 36. More specifically, the tie-bar of one circuit breaker is prevented from closing the circuit breaker contacts 54 if the contacts 56 of the other circuit breaker are closed. A representative description of the interaction between a circuit breaker tie-bar and the contacts can be found in U.S. Pat. No. 4,484,164.

Figure 2:
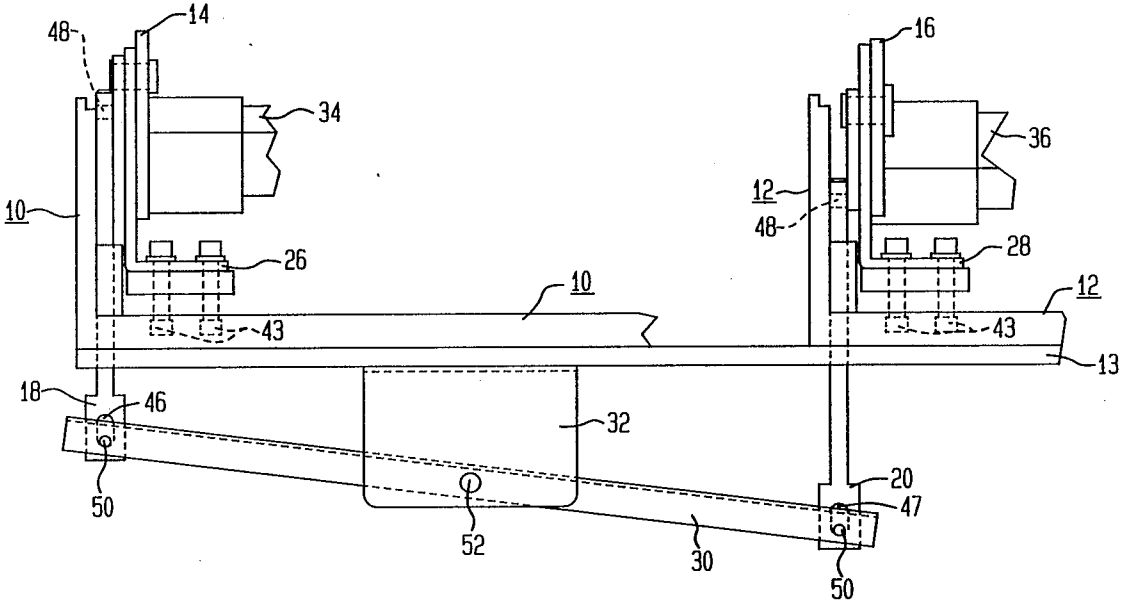
FIG. 2 is an end view of the interlock assembly.
Figure 3A:
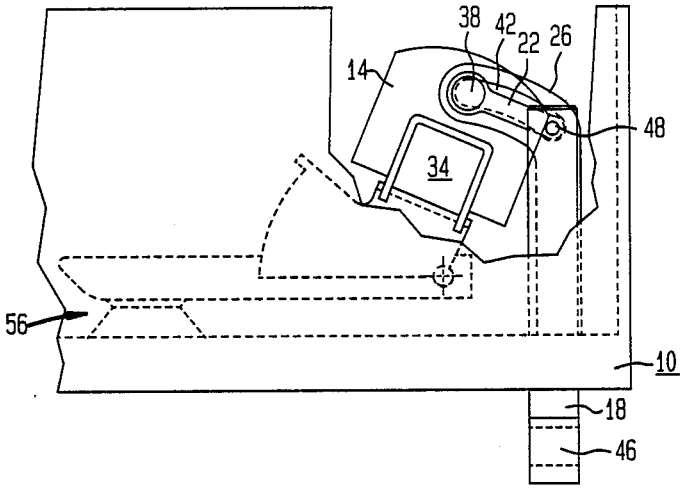
FIG. 3*a* is a side view of a portion of the interlock assembly, wherein the contacts of the circuit breaker are closed.
Figure 3B:
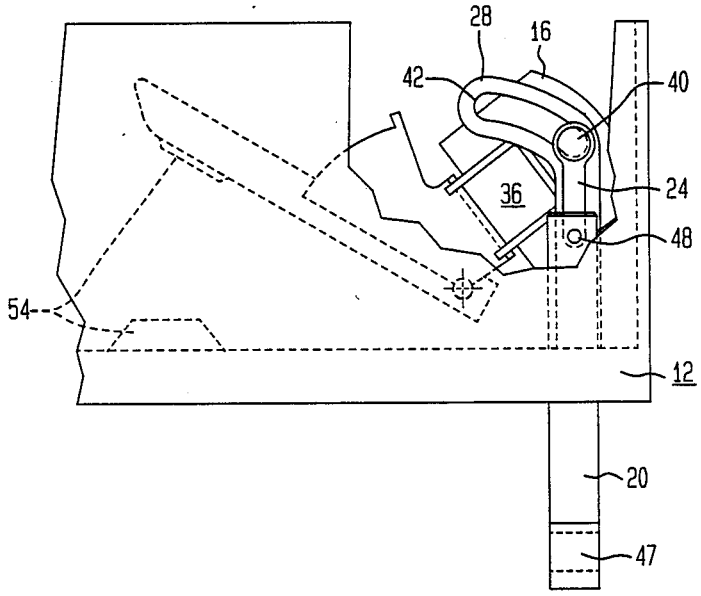
FIG. 3*b* is a side view of a portion of the interlock assembly, wherein the contacts of the circuit breaker are open.
Figure 4:
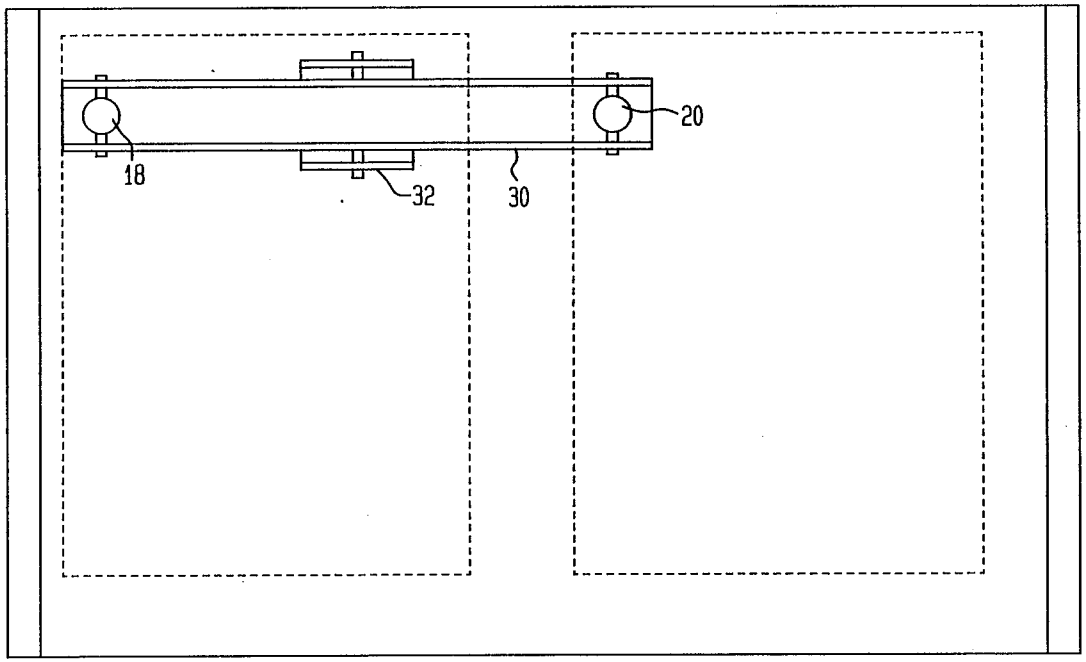
FIG. 4 is a bottom view of a portion of the interlock assembly.
Figure 5A:
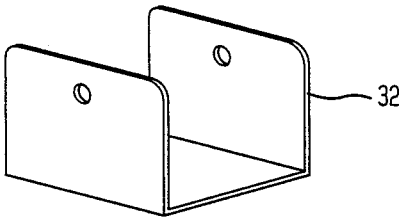
FIGS. 5*a*–5*d* illustrate the individual components of the interlock.
Figure 5B:
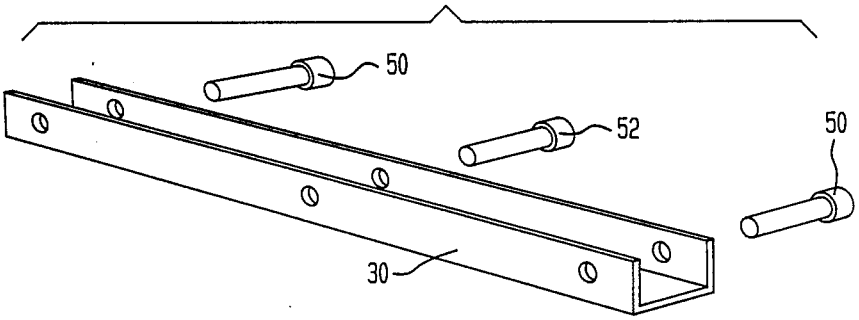
Figure 5C:
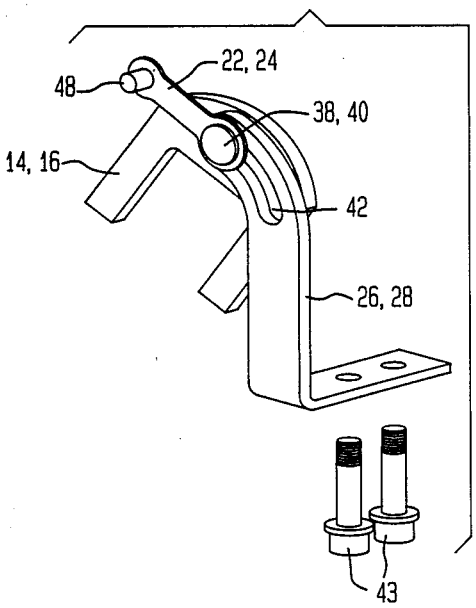
Figure 5D:
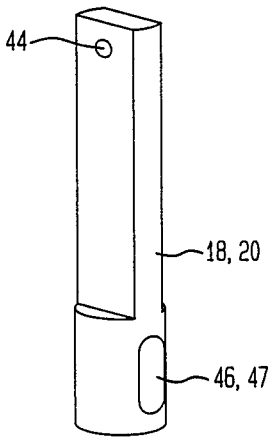

Referring now to FIG. 2, the mechanical interlock is illustrated in the position where one circuit breaker 10 is in the ON position and the other circuit breaker 12 is in the OFF position. When one of the circuit breakers 10 is switched to the ON position, the corresponding push-pull rod 18 is moved upwardly by the link 22 which is pulled along the slot 42 by the fork 14 when the tie-bar 34 causes the circuit breaker 10 contacts 56 to close. See FIG. 3. When the contacts are closed, the rocker arm is rotated clockwise such that the pin 50 is brought to rest at the bottom of the elongated slot 46 in the rod 18, while the pin 50 is also brought to rest in the bottom of the elongated slot 47 in the rod 20.

Accordingly, when the contacts 56 of the first circuit breaker 10 are closed, the interaction between the pin 50, rocker arm 30 and slot 47 restrict the rod 20 from moving upwardly. With the upward movement of the rod 20 being restricted, the contacts 54 of the circuit breaker 12 can not be closed since the link 24 is held in place by the rod 20 to prevent movement of the engagement fork 16 and the tie-bar 36.

It should also be understood that the interlock assembly described above also prevents the first circuit breaker 10 from being switched ON when the contacts 54 of the second circuit breaker 12 are closed.

While one embodiment of an interlock has been shown and described in detail herein, various other changes and modifications may be made to adapt the assembly for use in various articles. For example, the specific configurations of the interlock components could be modified for use with a wide range of circuit breakers. In another example, a telescoping cable assembly could be used to transfer motion from the tie-bars of the circuit breakers to an interlock member such as the rocker arm.

We claim:

1. An assembly for interlocking a first circuit breaker and a second circuit breaker, wherein the circuit breakers are of the type including a first electrical contact and a tie-bar coupled to a second electrical contact being engageable with the first electrical contact, the assembly comprising:

means for supporting the first circuit breaker and the second circuit breaker;

a pivot support supported by the means for supporting;

a pivot pin;

a rocker arm, the rocker arm being supported substantially at the center of the rocker arm by the pivot support, wherein the pivot pin pivotally couples the rocker arm and the pivot support;

an engagement member for engaging the tie-bar of the first circuit breaker;

a guide member including a slot, the guide member being mountable to the first circuit breaker with a first mounting means;

a link defining a first end and second end;

a rod defining a first end and a second end, wherein the second end includes a slotted opening and the rocker arm includes a first end and a means for engaging the slotted opening of the rod;

a guide pin being slidable within the slot of the guide member, the guide pin pivotally attaching the engagement member to the first end of the link;

a first pin for pivotally attaching the second end of the link to the first end of the rod; and a second means for transferring movement between the tie-bar of the second circuit breaker and the means for restricting movement, wherein the second means is coupled to the tie-bar of the second circuit breaker;

wherein the rod moves the rocker arm when the first electrical contact is engaged with the second electrical contact of the first circuit breaker such that the rocker arm moves the second means which prevents the first electrical contact from engaging the second electrical contact of the second circuit breaker.

2. The assembly of claim 1 wherein the second means for transferring movement comprises:

an engagement member for engaging the tie-bar of the second circuit breaker;

a guide member including a slot, the guide member being mountable to the second circuit breaker with a second mounting means;

a link defining a first end and second end;

a rod defining a first end and a second end, wherein the second end includes a slotted opening;

a guide pin being slidable within the slot of the guide member, the guide pin pivotally attaching the engagement member to the first end of the link; and a first pin for pivotally attaching the second end of the link to the first end of the rod;

wherein the rocker arm includes a second end and a means for engaging the slotted opening of the rod.

3. An assembly for interlocking a first circuit breaker and a second circuit breaker, wherein the circuit breakers are of the type including a first electrical contact and a tie-bar coupled to a second electrical contact being engageable with the first electrical contact, the assembly comprising:

a means for supporting the first circuit breaker and the second circuit breaker;

a pivot support supported by the means for supporting;

a pivot pin; and a rocker arm, the rocker arm being supported substantially at the center of the rocker arm by the pivot support, wherein the pivot pin pivotally couples the rocker arm and the pivot support;

an engagement member for engaging the tie-bar of the first circuit breaker;

a guide member including a slot, the guide member being mountable to the first circuit breaker with a first mounting means;

a link defining a first end and second end;

a rod defining a first end and a second end, wherein the second end includes a slotted opening, wherein the rocker arm includes a first end and a means for engaging the slotted opening of the rod;

means being slidable within the slot of the guide member, the guide pin pivotally attaching the engagement member to the first end of the link; and means for pivotally attaching the second end of the link to the first end of the rod;

a means for transferring movement between the tie-bar of the second circuit breaker and the rocker arm, wherein the second means is coupled to the tie-bar of the second circuit breaker;

wherein the rod rotates the rocker arm when the first electrical contact is engaged with the second electrical contact of the first circuit breaker such that rocker arm moves the second means which prevents the first electrical contact from engaging the second electrical contact of the second circuit breaker.

4. The assembly of claim 3 wherein the second means for transferring movement comprises:

an engagement member for engaging the tie-bar of the second circuit breaker;

a guide member including a slot, the guide member being mountable to the second circuit breaker with a second mounting means;

a link defining a first end and second end;

a rod defining a first end and a second end, wherein the second end includes a slotted opening;

a guide pin being slidable within the slot of the guide member, the guide pin pivotally attaching the engagement member to the first end of the link; and a first pin for pivotally attaching the second end of the link to the first end of the rod;

wherein the rocker arm includes a second end and a means for engaging the slotted opening of the rod.

* * * * *